US011152706B2

(12) United States Patent
Hamabe

(10) Patent No.: US 11,152,706 B2
(45) Date of Patent: Oct. 19, 2021

(54) ANTENNA DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/821,326

(22) Filed: Mar. 17, 2020

(65) Prior Publication Data

US 2020/0313301 A1 Oct. 1, 2020

(30) Foreign Application Priority Data

Mar. 29, 2019 (JP) ..... JP2019-068296

(51) Int. Cl.
*H01Q 9/16* (2006.01)
*H01Q 15/14* (2006.01)

(52) U.S. Cl.
CPC ..... *H01Q 9/16* (2013.01); *H01Q 15/14* (2013.01)

(58) Field of Classification Search
CPC ..... H01Q 9/16; H01Q 15/14; H01Q 19/108; H01Q 15/0086; H01Q 9/285
See application file for complete search history.

(56) References Cited

U.S. PATENT DOCUMENTS 7,405,698 B2 * 7/2008 de Rochemont .. H01Q 21/0025 343/700 MS
2013/0162491 A1 * 6/2013 Yu ..... H01Q 9/0407 343/767
2018/0183142 A1 * 6/2018 Hamabe ..... H01Q 9/30

FOREIGN PATENT DOCUMENTS

JP 2015-70542 4/2015

* cited by examiner

*Primary Examiner* — Seung H Lee
(74) *Attorney, Agent, or Firm* — Wenderoth, Lind & Ponack, L.L.P.

(57) ABSTRACT

An antenna device includes a first antenna conductor, a ground conductor, an artificial magnetic conductor sandwiched between the first antenna conductor and the ground conductor, and disposed separately from the first antenna conductor and the ground conductor, and a second antenna conductor disposed on a side opposite to the artificial magnetic conductor across the first antenna conductor and disposed furthest away from the ground conductor.

10 Claims, 14 Drawing Sheets

ANTENNA DEVICE

BACKGROUND

1. Technical Field

The present disclosure relates to an antenna device.

2. Description of the Related Art

Patent Literature (PTL) 1 discloses an antenna device including an artificial magnetic conductor (AMC) reflection plate that uses an AMC.

Here, PTL 1 is Unexamined Japanese Patent Publication No. 2015-70542.

SUMMARY

It is an object of the present disclosure to provide an antenna device that easily adjusts an operation frequency applicable for wireless communication and maintains frequency characteristics of an operation frequency band.

The present disclosure is an antenna device including a first antenna conductor, a ground conductor, an artificial magnetic conductor sandwiched between the first antenna conductor and the ground conductor, and disposed separately from the first antenna conductor and the ground conductor, and a second antenna conductor disposed on a side opposite to the artificial magnetic conductor across the first antenna conductor and disposed furthest away from the ground conductor.

According to the present disclosure, an antenna device can easily adjust an operation frequency applicable for wireless communication and maintain frequency characteristics of an operation frequency band.

Figure 1:
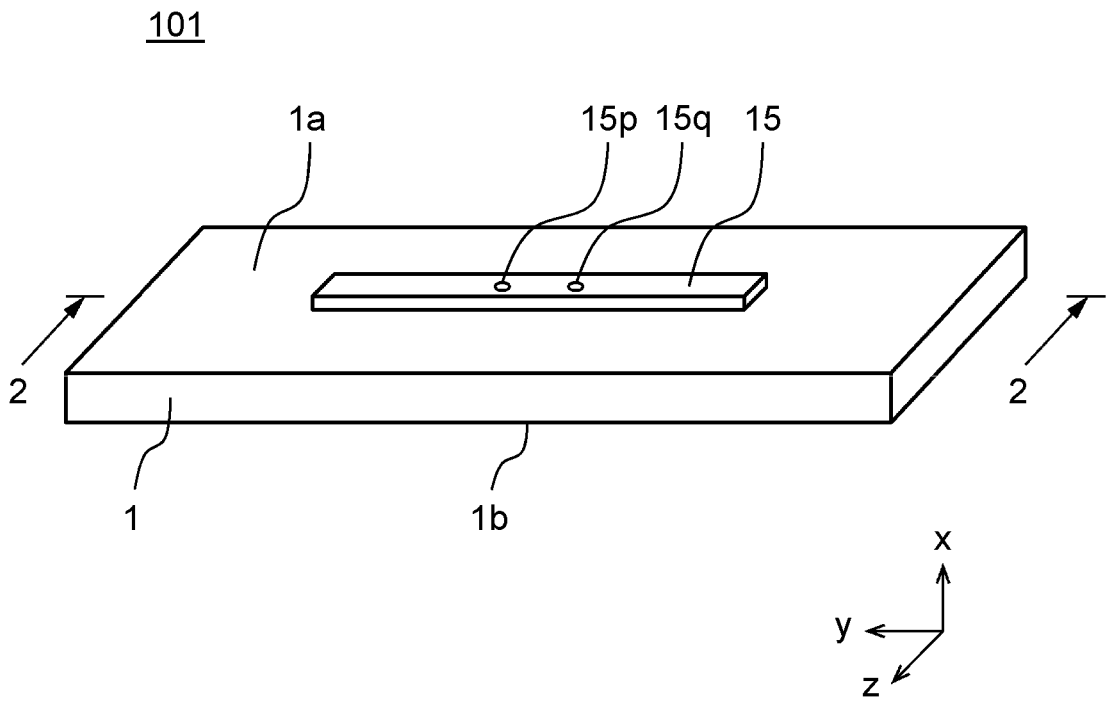
FIG. 1 is an external perspective view of an antenna device according to an exemplary embodiment.

DETAILED DESCRIPTION (Circumstance that Leads to the Present Disclosure)

In an antenna device of known art, e.g., PTL 1, an AMC reflection plate is disposed in an intermediate layer in the entire antenna device. Therefore, when the antenna device is manufactured and attached in an actual arrangement environment, it has been difficult to adjust an operation frequency (i.e., communication frequency) band applicable for wireless communication performed by the antenna device. For example, when the antenna device is attached in the actual arrangement environment (e.g., in a space where metal is provided), the operation frequency band corresponding to the antenna device can be shifted to a high frequency side. In the case of occurrence of such shift, in order to finely adjust the operation frequency band to match a desired frequency band (e.g., 2450 MHz in the case of Bluetooth (registered trademark)), an operation, e.g., adjustment of the length of a patch element of the AMC reflection plate, has been needed. In other words, an operation of remaking an antenna device is practically generated, causing a reduction in convenience of an operator.

Thus, in an exemplary embodiment below, a description is given of an example of an antenna device that easily adjusts an operation frequency applicable for wireless communication and maintains frequency characteristics of an operation frequency band. For example, as the operation frequency band of the antenna device, 2.45 GHz band of Bluetooth (registered trademark) is indicated. Note that the operation frequency band of the antenna device may not be a frequency band of Bluetooth (registered trademark), but may be a frequency band corresponding to wireless local area network (LAN), e.g., Wi-Fi (registered trademark).

The exemplary embodiment that specifically discloses the antenna device of the present disclosure is described in detail below with reference to the drawings properly. However, a detailed description more than necessary may be omitted. For example, a detailed description of a well-known matter or a redundant description regarding the substantially same configuration may be omitted. The reason for this is to avoid unnecessary redundancy of the following description and to help a person of ordinary skill in the art to achieve easy understanding. The accompanying drawings and the following description are provided in order for a person of ordinary skill in the art to get a sufficient understanding of the present disclosure, and therefore, this is not intended to impose a limitation on a subject matter that is recited in a claim.

The antenna device according to the exemplary embodiment below is used, for example, in an electronic device mounted in an aircraft. In the case of an economy class, for example, the antenna device is disposed in a housing of a seat monitor set on the rear surface of a seat of the aircraft. In the case of a first class, for example, the antenna device is disposed in a housing of a cabin monitor set on a wall surface of a cabin. Examples of intended purposes of the antenna device include not only the monitor, but also many IoT (Internet of Things) devices including a main phone and a secondary phone of a cordless telephone unit, an electronic shelf label (e.g., a card-type electronic device that is attached to a store shelf in a retail store and displays a selling price of a product), a smart speaker, an automotive device, a microwave oven, and a refrigerator.

The antenna device of the exemplary embodiment includes a dipole antenna that forms a parallel resonant circuit. The dipole antenna is formed such that a metal foil on a surface of a printed circuit board, which is a laminated board, is, for example, etched away. The laminated board is formed of a plurality of layers including a copper foil and glass epoxy.

FIG. 1 is an external perspective view of antenna device 101 according to the exemplary embodiment. Antenna device 101 includes printed circuit board 1 having an elongated plate shape. Front surface 1*a* of printed circuit board 1 is a secondary element surface on which secondary element 15 is centrally disposed. Back surface 1*b* of printed circuit board 1 is a ground conductor surface on which ground conductor 8 (see FIG. 2) is formed entirely. Here, a direction perpendicular to the surface of printed circuit board 1 is an x direction. A direction parallel to and extending longitudinally along the surface of printed circuit board 1 is a y-direction. A direction parallel to and extending transversely along the surface of printed circuit board 1 is a z direction.

Figure 2:
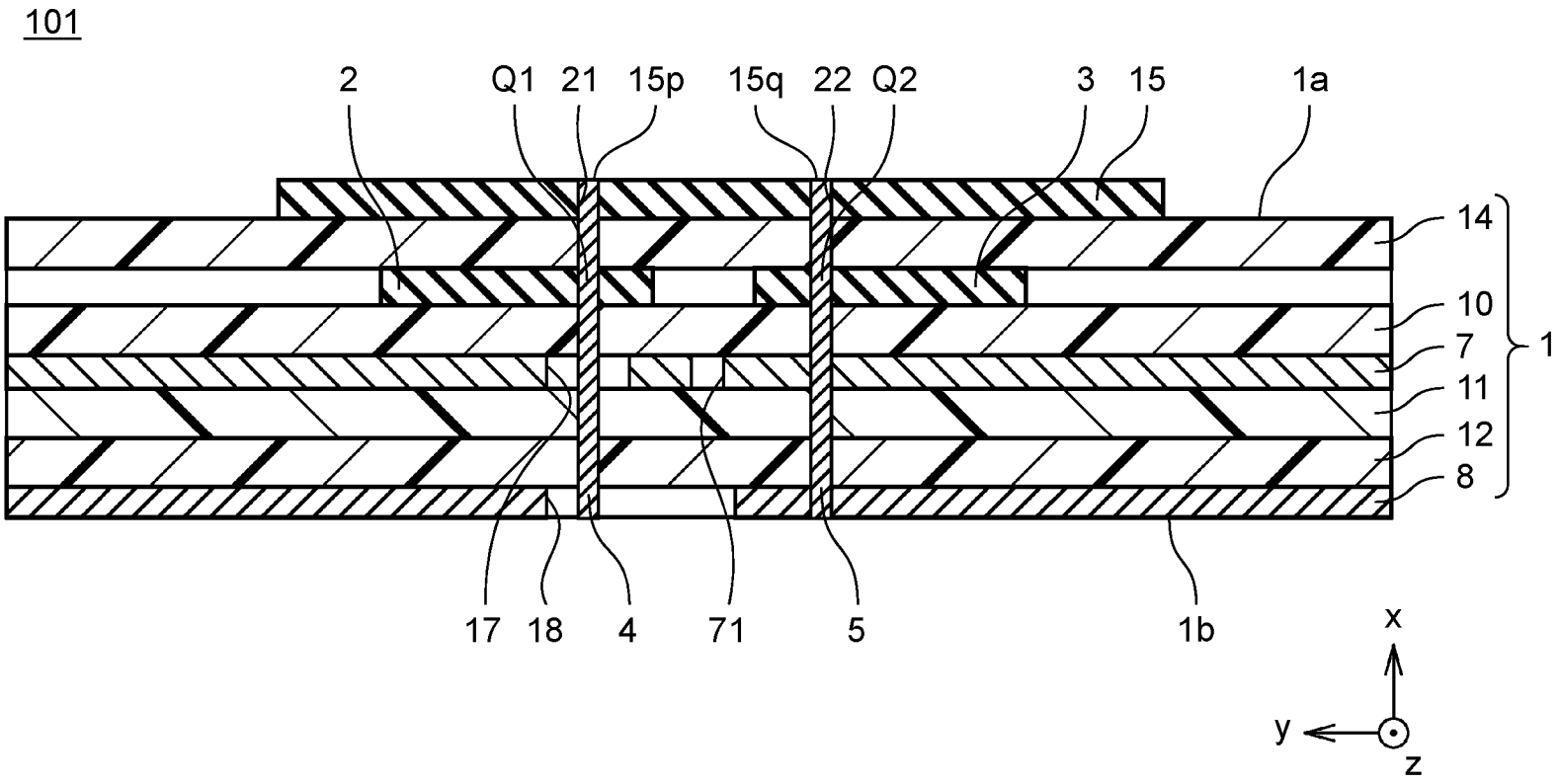
FIG. 2 is a vertical cross-sectional view taken along line 2-2 of FIG. 1.

FIG. 2 is a vertical cross-sectional view taken along line 2-2 of FIG. 1. Printed circuit board 1 is a laminated board on which dielectric substrate 12 on which ground conductor 8 is formed, dielectric substrate 11 on which artificial magnetic conductor (i.e., AMC 7) is formed, dielectric substrate 10 on which antenna conductors 2, 3 (an example of a first antenna conductor) and parasitic conductor 6 (see FIG. 3) are formed, and dielectric substrate 14 on which secondary element 15 (an example of the second antenna conductor) is formed are stacked in order. Dielectric substrates 10, 11, 12, 14 (an example of the substrate) are formed, for example, of glass epoxy. AMC 7 is an artificial magnetic conductor having perfect magnetic conductor (PMC) characteristics, and is formed of a predetermined metal (e.g., copper) pattern. AMC 7 is stacked for a reduction in thickness and an increase in gain of antenna device 101. Note that, here, dielectric substrate 11 on which AMC 7 is formed is separated from dielectric substrate 12 on which ground conductor 8 is formed. However, the AMC may be formed on the surface (surface in the x-direction) of a common dielectric substrate, and the ground conductor may be formed on the back surface (surface in a −x direction).

Figure 3:
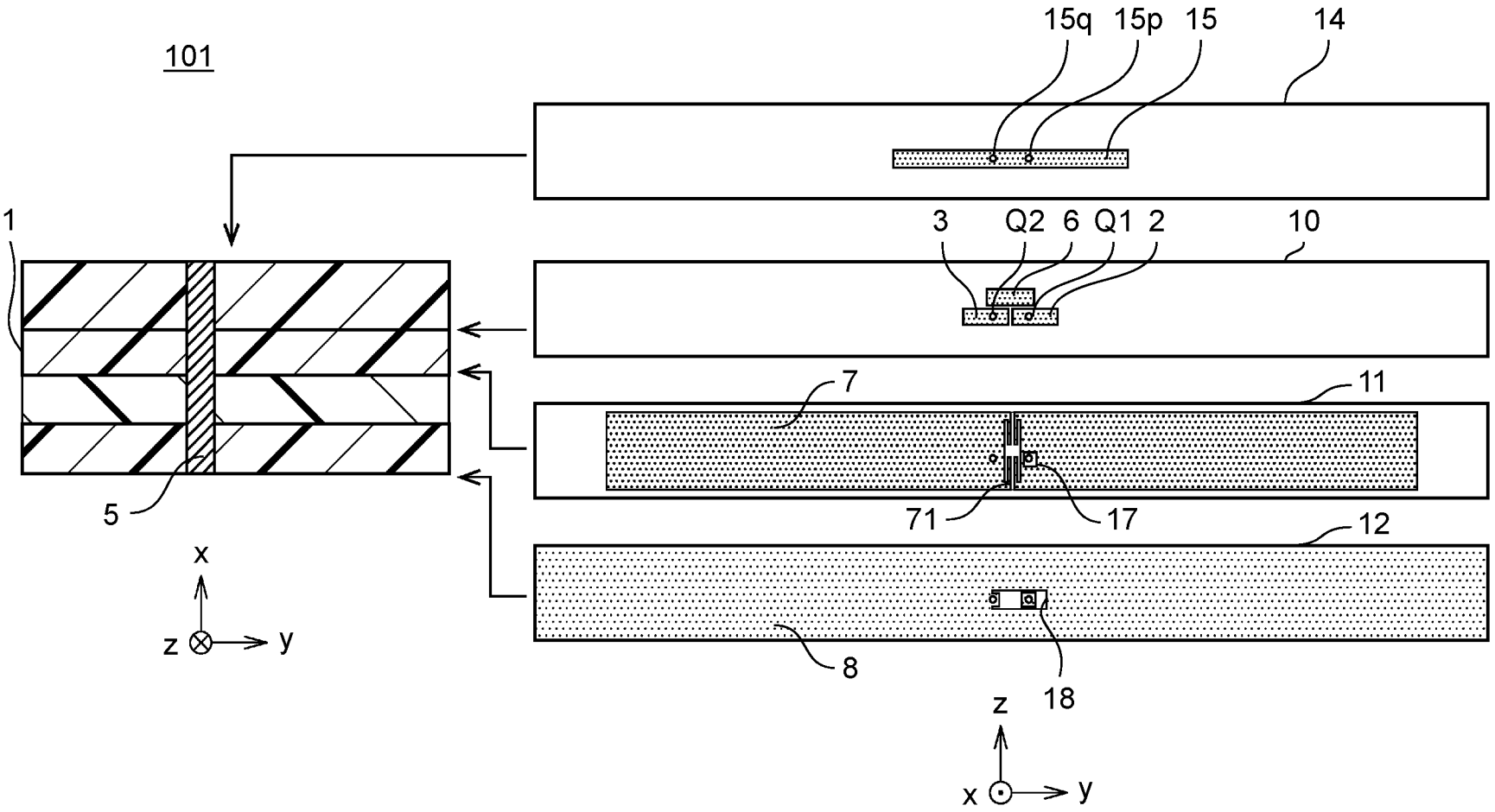
FIG. 3 is a plan view illustrating each layer constituting the antenna device.

FIG. 3 is a plan view illustrating each layer constituting antenna device 101. Antenna device 101 includes a ground (GND) layer including ground conductor 8, an AMC layer including AMC 7, an antenna layer including antenna conductors 2, 3 and parasitic conductor 6, and a secondary element layer including secondary element 15.

The antenna layer includes antenna conductor 2, which is a strip conductor as an example of the feed antenna, antenna conductor 3, which is a strip conductor as an example of the parasitic antenna, and parasitic conductor 6 disposed on sides of antenna conductors 2, 3. Antenna conductors 2, 3 have, as an example, a width dimension of 1 mm. Antenna conductor 2 is an example of the feed-side antenna conductor. Antenna conductor 3 is an example of the ground-side antenna conductor.

Here, the longitudinal direction of antenna device 101 and antenna conductors 2, 3 is a y-axis direction (see FIG. 1). The width direction of antenna device 101 and antenna conductors 2, 3 is a z-axis direction (see FIG. 1). The thickness direction of antenna device 101 is an x-axis direction perpendicular to an xy plane (see FIG. 1).

In printed circuit board 1, via conductors 4, 5 are formed in substantially opposite positions immediately below respective feedpoints Q1, Q2. Note that printed circuit board 1 of antenna device 101 may be mounted, for example, on a printed circuit board of an electronic device.

Parasitic conductor 6 is electrically separated from antenna conductors 2, 3. Antenna conductors 2, 3 are connected respectively to via conductors 4, 5 of printed circuit board 1. Via conductor 4 constitutes a feed wire between feedpoint Q1 of antenna conductor 2 and a wireless communication circuit (not illustrated). The wireless communication circuit is mounted, for example, on back surface 1*b* of printed circuit board 1. Via conductor 5 constitutes a ground wire between feedpoint Q2 of antenna conductor 3 and the aforementioned wireless communication circuit.

Antenna conductors 2, 3 are formed on the surface of dielectric substrate 10 to constitute a dipole antenna such that the longitudinal direction extends on a straight line in the y direction and in the −y direction and ends of antenna conductors 2, 3 adjacent to respective feedpoints Q1, Q2 are separated from each other at a predetermined distance.

Parasitic conductor 6 is disposed adjacently to antenna conductors 2, 3 with a predetermined distance. The predetermined distance is, for example, within a quarter of received radio wave wavelength. Parasitic conductor 6 is disposed on one side surface side of antenna conductors 2, 3 so as to be in parallel to a direction that antenna conductors 2, 3 are disposed (i.e., in the y direction and the −y direction). As parasitic conductor 6 is electrostatically coupled to AMC 7 similar to antenna conductors 2, 3, parasitic conductor 6 can increase electrostatic capacitance between antenna conductors 2, 3 and AMC 7 and shift a radio frequency handled by antenna device 101 to a low frequency side. Note that a size, a shape, a number, and the like of parasitic conductor 6 are not particularly limited. As long as parasitic conductor 6 is present on the same side of antenna conductors 2, 3 and electrostatically coupled to AMC 7, parasitic conductor 6 may not be disposed on the same surface as antenna conductors 2, 3, but may be disposed on the same surface as AMC 7.

Via conductors 4, 5 are formed such that a conductor is charged into an open hole, which is a through-hole or a via hole, formed in the direction of the thickness through front surface 1*a* and back surface 1*b* of printed circuit board 1. Antenna conductor 2, which functions as a feed antenna, is connected via via conductor 4 to a power feed terminal of the wireless communication circuit (see the above) on back surface 1*b* of printed circuit board 1. Moreover, antenna conductor 3, which functions as a parasitic antenna, is connected via via conductor 5 to AMC 7 and ground conductor 8 of printed circuit board 1, and a ground terminal of the wireless communication circuit (see the above).

Via conductor 4 is a feed wire having, for example, a cylindrical shape and feeding electric power for driving antenna conductor 2 as an antenna. Via conductor 4 electrically connects antenna conductor 2 formed on front surface 1*a* of printed circuit board 1 to the power feed terminal of the wireless communication circuit (see the above). Via conductor 4 is formed to be substantially coaxial with via conductor insulation holes 17, 18 formed on AMC 7 and ground conductor 8, respectively, so as not to be electrically connected to AMC 7 and ground conductor 8. Via conductor 4 has a diameter smaller than the diameters of via conductor insulation holes 17, 18 (see FIG. 2).

Meanwhile, via conductor 5 electrically connects antenna conductor 3 to the ground terminal of the wireless communication circuit (see the above). Via conductor 5 is electrically connected to ground conductor 8 and AMC 7. The surface of the AMC layer, which corresponds to antenna conductor 2, and the surface of the ground (GND) layer are not connected (i.e., non-conductive), and the surface of the antenna layer and the surface of the AMC layer, which correspond to antenna conductor 3, and the surface of the GND layer are connected (i.e., conductive). However, via conductor 5 may not be electrically connected to AMC 7, and the surface of the AMC layer, which correspond to antenna conductor 3, and the surface of the GND layer may not be connected.

As illustrated in FIG. 3, slit 71 is formed to extend through AMC 7 in a central portion in the y-axis direction to a vicinity of ends in the width direction. Slit 71 is a portion of the AMC layer where the artificial magnetic conductor is not formed. Slit 71 can separate AMC 7 in accordance with the positions of antenna conductors 2, 3 to increase electrostatic coupling between antenna conductor 2 and a right half portion of AMC 7 (i.e., the −y direction illustrated in FIG. 3) and electrostatic coupling between antenna conductor 3 and a left half portion of AMC 7 (i.e., the y direction illustrated in FIG. 3). Note that slit 71 may be formed to reach both ends of AMC 7 in the width direction to completely separate AMC 7 into two.

Ground conductor 8 is an earth region connected to the ground terminal of the wireless communication circuit (see the above). Ground conductor 8 includes via conductor insulation hole 18 formed to cause via conductor 4 to extend through and to be electrically insulated from ground conductor 8 and a hole formed to cause via conductor 5 to extend through and to be electrically insulated from ground conductor 8.

In antenna device 101, the plane shape of AMC 7 is, as compared with the plane shape of ground conductor 8, slightly smaller (substantially the same) in the length direction and the width direction. Moreover, AMC 7 and ground conductor 8 are formed to face each other and to be overlapped at a predetermined interval in the thickness direction. Specifically, ground conductor 8 has a plane shape having the same dimension as the surface of dielectric substrate 12 (as one example, width of 6 mm). AMC 7 is formed to have a width of 5 mm to leave a margin (clearance) of 0.5 mm at ends in up-and-down direction (z direction and −z direction) with respect to dielectric substrate 11 having a width of 6 mm. Accordingly, the length of AMC 7 in the longitudinal direction is formed to be substantially the same as the length of ground conductor 8 in the longitudinal direction. Thus, one of AMC 7 and ground conductor 8 does not protrude over the other, making a contribution to reducing the size of printed circuit board 1, eventually resulting in a reduction in size of antenna device 101.

Secondary element 15 is provided to improve the antenna performance of antenna device 101. Secondary element 15 is disposed at the center of the surface of dielectric substrate 14 and is formed of a copper foil to have an elongated plate shape. The dimension of secondary element 15 is, as an example, a length of 10 mm and a width of 1 mm. Secondary element 15 is stacked and exposed on the surface of antenna device 101. Therefore, the dimension can be adjusted after manufacture of antenna device 101. Secondary element 15 includes feed-side terminal 15*p* of via conductor 4 that is inserted into hole 21 through which via conductor 4 extends and conductively connected to secondary element 15, and ground-side terminal 15*q* of via conductor 5 that is inserted into hole 22 through which via conductor 5 extends and conductively connected to secondary element 15.

A use state of antenna device 101 having the aforementioned configuration is indicated.

Figure 4:
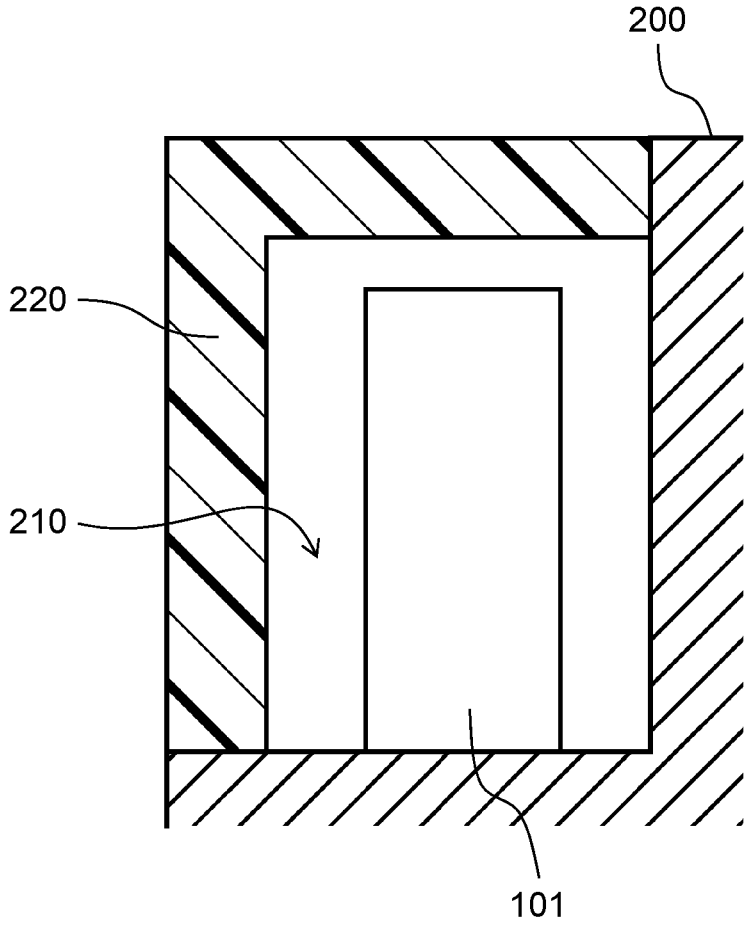
FIG. 4 is a partially enlarged cross-sectional view illustrating a frame into which the antenna device is incorporated.

Antenna device 101 is, as an example, incorporated into a metal frame attached to the front surface of the interior of the housing of the cabin monitor. FIG. 4 is a partially enlarged cross-sectional view illustrating metal frame 200 into which antenna device 101 is incorporated. Metal frame 200 is formed of a metal material, e.g., steel. Metal frame 200 provides support to reinforce protective glass, which is a part of a liquid crystal display that is fit inside. At an upper portion of metal frame 200, pocket 210 having a rectangular hollow shape is formed. Antenna device 101 is fixed to a bottom surface of pocket 210 with an adhesive, a screw, or the like. When antenna device 101 is fixed to the bottom surface of pocket 210, the distance between antenna device 101 and the bottom surface and the back surface of metal frame 200 facing antenna device 101 is kept constant. When the distance between the metal that becomes closer in the space where antenna device 101 is incorporated and antenna device 101 becomes constant, the antenna performance of antenna device 101 that transmits and receives an electromagnetic wave of a high frequency band, e.g., a microwave, becomes stable. Moreover, cover 220 having an L angled shape is fit to a peripheral portion of pocket 210 of metal frame 200 to cover pocket 210. The material of cover 220 is nonmetal, e.g., resin. Note that here is indicated the case where the two surfaces of the pocket into which the antenna device is incorporated, the bottom surface and the back surface, are a metallic frame, but only one surface, i.e., the bottom surface, may be a metallic frame, or the three surfaces, the bottom surface, the back surface, and the upper surface, may be a metallic frame.

Moreover, the antenna device may be bonded to a back side of the protective glass with a double-sided tape. When the antenna device is bonded to the protective glass with a double-sided tape, under the absence of the secondary element layer, the distance between the surface of the antenna layer and the surface of the protective glass varies with the thickness of the double-sided tape. Therefore, when the thickness of the double-sided tape is not constant due to the material or the like, the distance between the antenna conductor disposed on the surface of the antenna layer and the metal frame present behind the antenna device is not stable, which affects the antenna performance. Meanwhile, in the exemplary embodiment, because the secondary element layer is provided on the front surface of the antenna layer, the distance between the surface of the antenna layer and the surface of the protective glass varies with the thickness of the double-sided tape and the thickness of the secondary element layer. Because the thickness of the secondary element layer is constant, even when the thickness of the double-sided tape is not constant due to the material or the like, variations in distance between the surface of the antenna layer and the surface of the protective glass are mitigated as a whole. Thus, variations in distance with respect to the metal frame present behind antenna device 101 are suppressed, thereby suppressing an adverse effect on the antenna performance.

Figure 5:
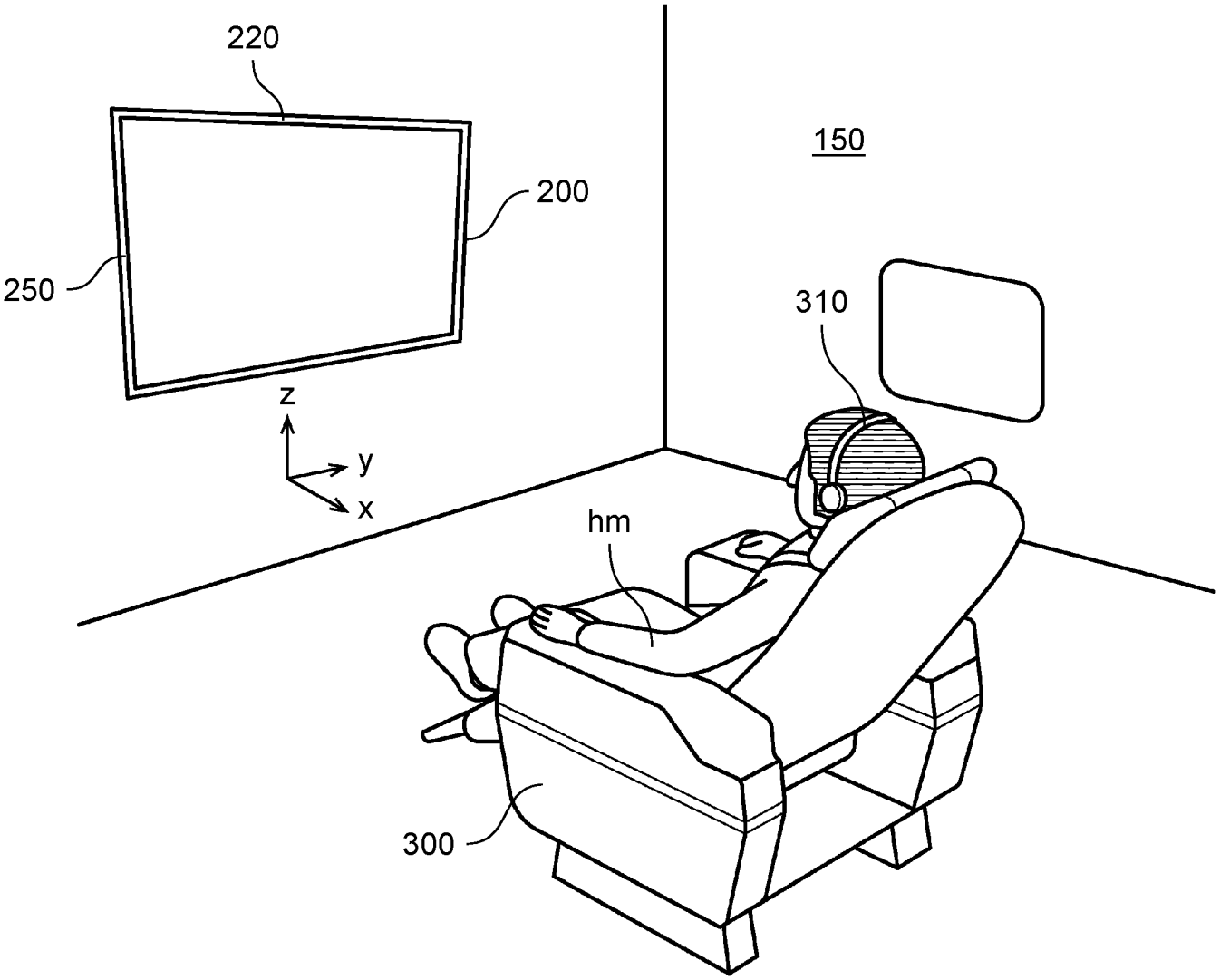
FIG. 5 is a view illustrating a cabin monitor set in a cabin, and a passenger.

FIG. 5 is a view illustrating cabin monitor 250 set in cabin 150 of an aircraft, and passenger hm. Passenger hm is assumed to watch cabin monitor 250 in a state of leaning against seat 300 in cabin 150. One part of the upper portion of metal frame 200 of cabin monitor 250 is covered with cover 220. Antenna device 101 is incorporated into metal frame 200 covered with cover 220. Passenger hm wears headphone 310 that can receive a radio wave for short range communication (e.g., radio waves of 2.4 GHz band). Headphone 310 receives, for example, a radio wave of 2.4 GHz band that is transmitted by antenna device 101 in the direction of passenger hm (x direction), and, on the basis of an audio signal included in the received signal, outputs an audio synchronized with a video shown on cabin monitor 250.

Next, characteristics of radio frequency of antenna device 101 of the exemplary embodiment are described.

Figure 6:
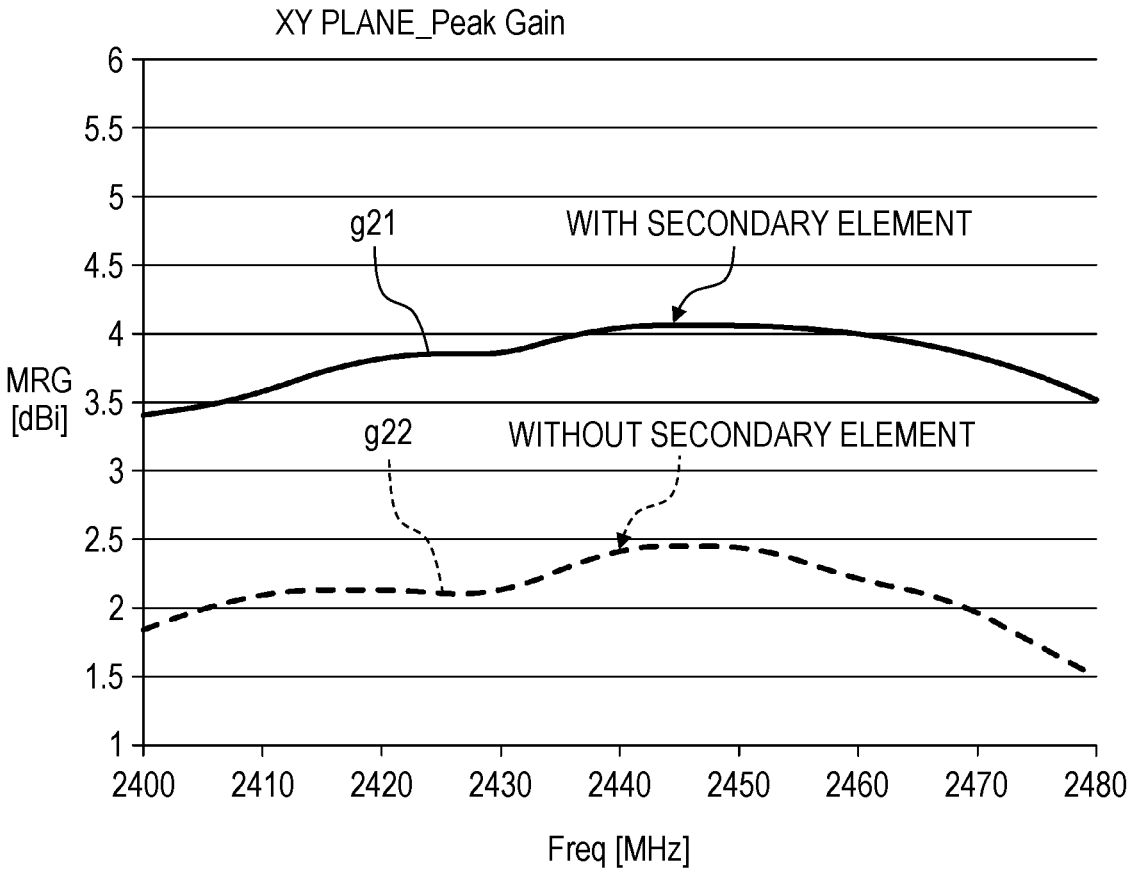
FIG. 6 is a graph illustrating a change in gain with respect to a frequency in an X-Y plane with respect to an antenna device with a secondary element of the exemplary embodiment and an antenna device without a secondary element of a comparative example.

FIG. 6 is a graph illustrating a change in gain with respect to a frequency in an X-Y plane with respect to antenna device 101 with secondary element 15 of the exemplary embodiment and an antenna device without a secondary element of a comparative example. The horizontal axis of the graph indicates a frequency of 2.40 GHz to 2.48 GHz band. The vertical axis of the graph indicates mean effective gain (MRG).

In the case of antenna device 101 with secondary element 15, as indicated by graph g21, the gain in the X-Y plane is high, indicating a value around 3.5 dBi to 4 dBi in the frequency bandwidth of 2.40 GHz to 2.48 GHz. Meanwhile, in the case of the antenna device without the secondary element, as indicated by graph g22, the gain is lower than the gain of antenna device 101, indicating a value around 1.5 dBi to 2.5 dBi in the frequency bandwidth of 2.40 GHz to 2.48 GHz. Thus, the antenna device including the secondary element increases the gain in the X-Y plane of the antenna device.

Figure 7:
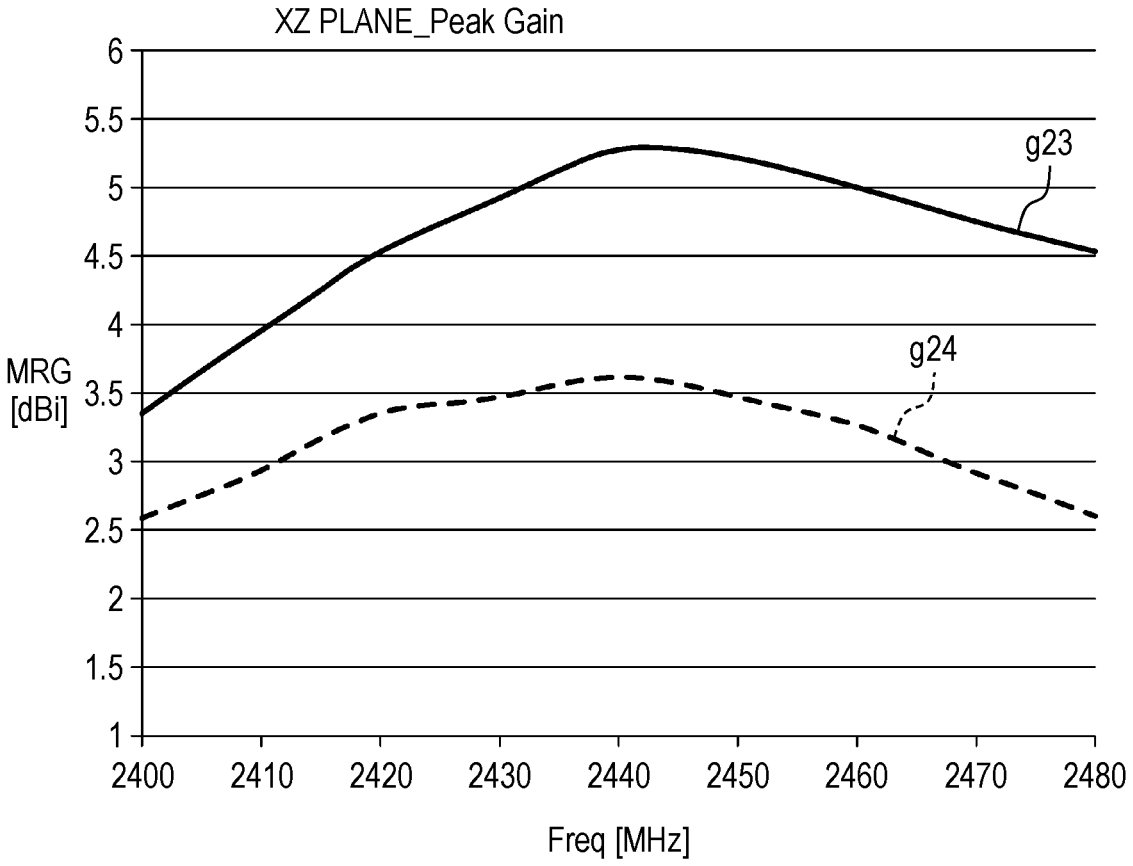
FIG. 7 is a graph illustrating a change in gain with respect to a frequency in an X-Z plane with respect to the antenna device with the secondary element of the exemplary embodiment and the antenna device without the secondary element of the comparative example.

FIG. 7 is a graph illustrating a change in gain with respect to a frequency in the X-Z plane with respect to antenna device 101 with secondary element 15 of the exemplary embodiment and the antenna device without the secondary element of the comparative example. The horizontal axis of the graph indicates a frequency of 2.40 GHz to 2.48 GHz band. The vertical axis of the graph indicates mean effective gain (MRG).

In the case of antenna device 101 with secondary element 15, as indicated by graph g23, the gain in the X-Z plane is high, indicating a value around 3.5 dBi to 5.5 dBi in the frequency bandwidth of 2.40 GHz to 2.48 GHz. Meanwhile, in the case of the antenna device without the secondary element, as indicated by graph g24, the gain is lower than the gain of antenna device 101, indicating a value around 2.5 dBi to 3.5 dBi in the frequency bandwidth of 2.40 GHz to 2.48 GHz. Thus, the antenna device including the secondary element increases the gain in the X-Z plane of the antenna device.

Figure 8:
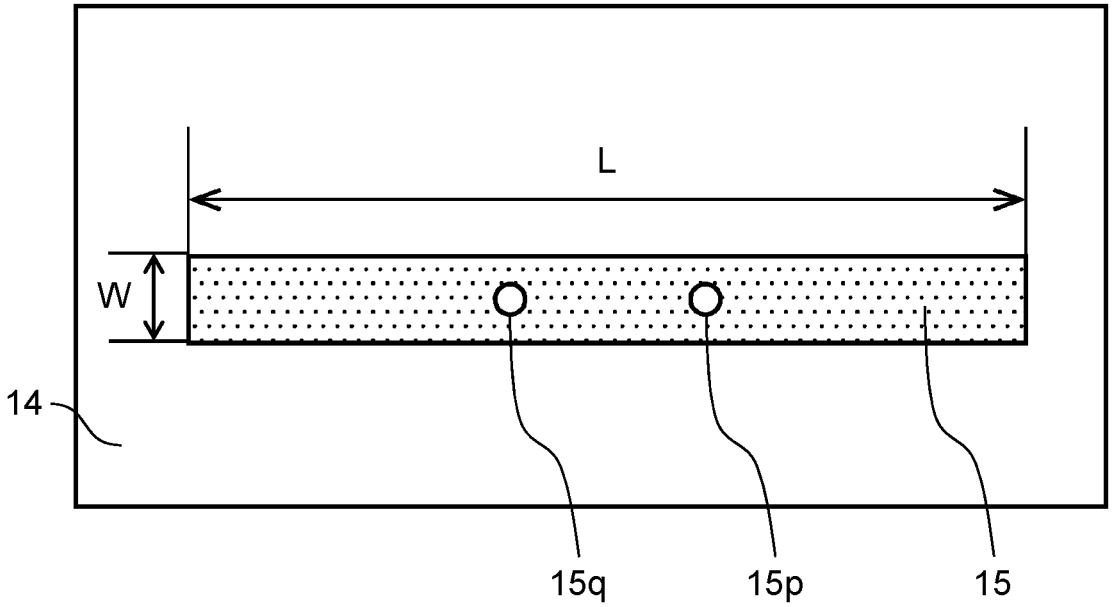
FIG. 8 is a view for explaining a length of the secondary element.

FIG. 8 is a view for explaining length L of secondary element 15. As described above, secondary element 15 is disposed at the center of the surface of dielectric substrate 14 and is formed of a copper foil to have an elongated plate shape. Secondary element 15 is disposed on the surface of dielectric substrate 14, which is the outermost of antenna device 101. Therefore, the dimension of secondary element 15 can be adjusted by cutting or the like even after manufacture of antenna device 101. Length L (distance in the y direction) and width W (distance in the z direction) of secondary element 15, which are dimensions of secondary element 15, are changed. Note that the thickness (distance in the x direction) of secondary element 15 may be changed.

Figure 9:
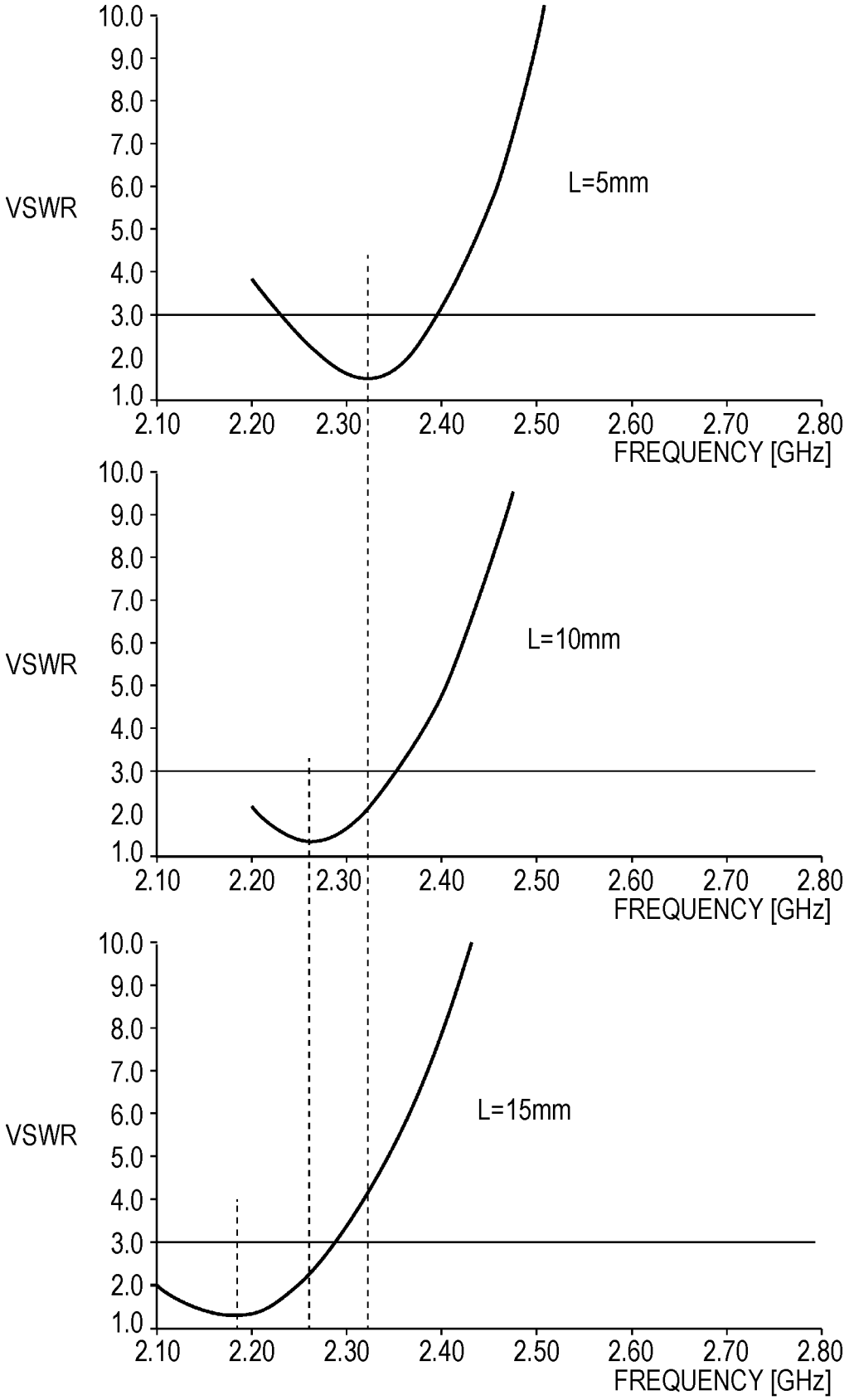
FIG. 9 is a graph illustrating a change in antenna characteristics of the antenna device in a case where the length of the secondary element is changed.

FIG. 9 is a graph illustrating a change in antenna characteristics of antenna device 101 in a case where length L of secondary element 15 is changed. The vertical axis indicates a voltage standing wave ratio (VSWR), and the horizontal axis indicates a frequency. The graph illustrated in FIG. 9 indicates center frequencies of VSWR and bandwidths corresponding to three different lengths L. The VSWR represents the degree of impedance matching (that is to say, degree of reflection) by a rate of a traveling wave and a reflected wave in a standing wave. In particular, the VSWR is calculated using a rate of maximum amplitude and minimum amplitude of a voltage of a radio wave that is a standing wave. The closer the VSWR is to 1, the less the reflected wave and the impedance matching is achieved. Accordingly, the closer the VSWR is to 1, the higher the transmission efficiency of a radio wave. Moreover, in the exemplary embodiment, a frequency band with a VSWR of less than or equal to 3.0 is determined as a fractional bandwidth, and whether the frequency band is a wide band or a narrow band is determined by the fractional bandwidth. The fractional bandwidth is calculated when the bandwidth with a VSWR of less than or equal to 3.0 is divided by the center frequency.

FIG. 9 indicates, as an example, the center frequency of the VSWR and the fractional bandwidth in a frequency band near 2.2 GHz. When length L of secondary element 15 is 5 mm, the center frequency of the VSWR is 2.32 GHz. When length L is 10 mm, the center frequency of the VSWR is 2.26 GHz. When length L is 15 mm, the center frequency of the VSWR is 2.18 GHz. Thus, center frequency of the VSWR shifts to low frequency with an increase in length of the secondary element 15. In setting the communication frequency, by increasing length L of secondary element 15, the communication frequency can be adjusted to shift to a low frequency side. Moreover, by reducing length L of secondary element 15, the communication frequency can be adjusted to shift to a high frequency side.

Moreover, when the curve of the VSWR is assumed to be substantially symmetrical relative to the center frequency, the fractional bandwidth is a value obtained when the bandwidth from the center frequency to the high frequency-side frequency where the VSWR is 3.0 is doubled. When length L is 5 mm, the fractional bandwidth of the VSWR is 0.55 GHz×2. When length L is 10 mm, the fractional bandwidth of the VSWR is 0.9 GHz×2. When length L is 15 mm, the fractional bandwidth of the VSWR is 1.1 GHz×2. Thus, the longer the length of secondary element 15, the larger the value of the fractional bandwidth of the VSWR. That is, a change to wide band is promoted. Accordingly, it is possible to make adjustment to increase the fractional bandwidth of the VSWR by increasing length L of secondary element 15. Such shifting of the communication frequency to a low frequency side and a change to a wide band are presumable due to the fact that an increase in width of secondary element 15 increases the electrical length (path length) of AMC 7, thereby causing parallel resonance to occur easily.

Figure 10:
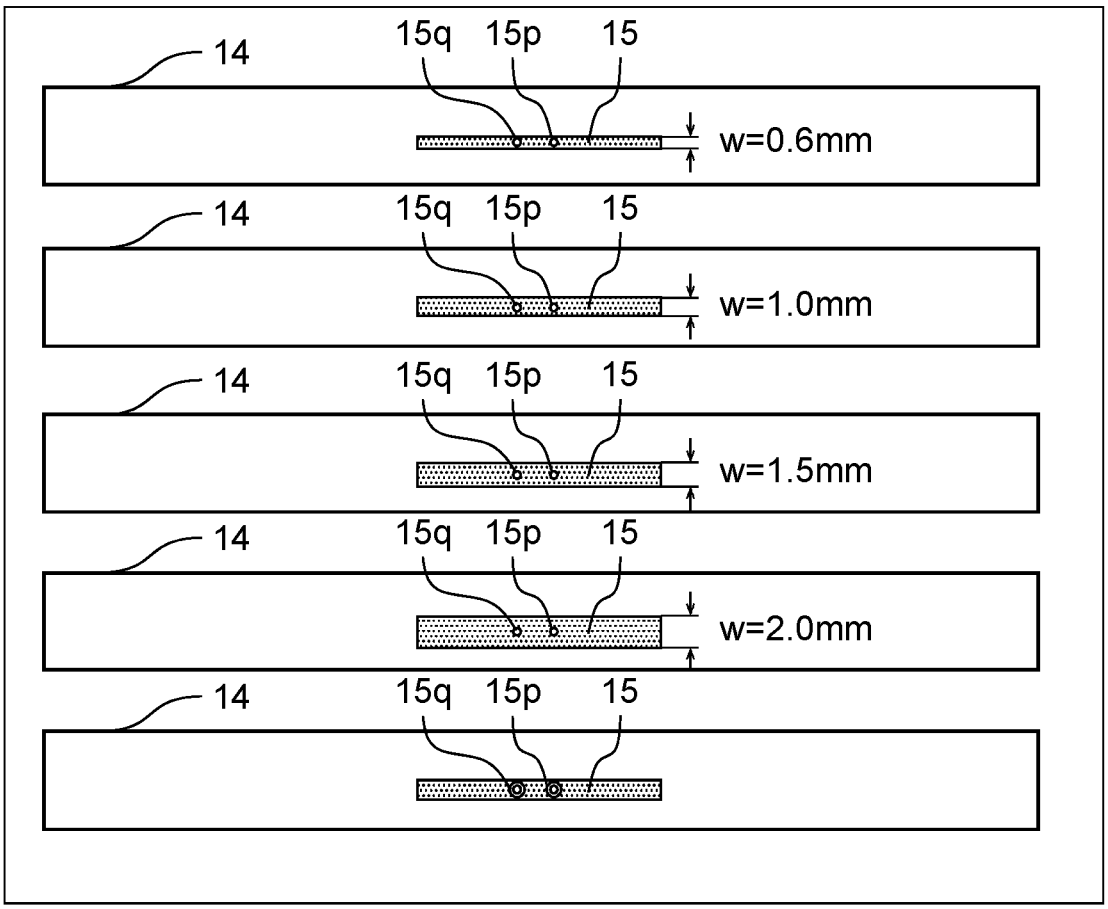
FIG. 10 is a view illustrating surfaces of secondary element layers on which secondary elements having different widths are disposed.

FIG. 10 is a view illustrating surfaces of secondary element layers on which secondary elements 15 having different width W are disposed. FIG. 10 illustrates surfaces of secondary element layers having width W of 0.6 mm, 1.0 mm, 1.5 mm, and 2.0 mm. Note that, as another example, a surface of a secondary element layer in a case where two via conductors are not conductively connected to a secondary element is indicated. Note that the two via conductors and the secondary element of the aforementioned another example correspond to via conductors 4, 5 and secondary element 15 of the exemplary embodiment, respectively.

Figure 11:
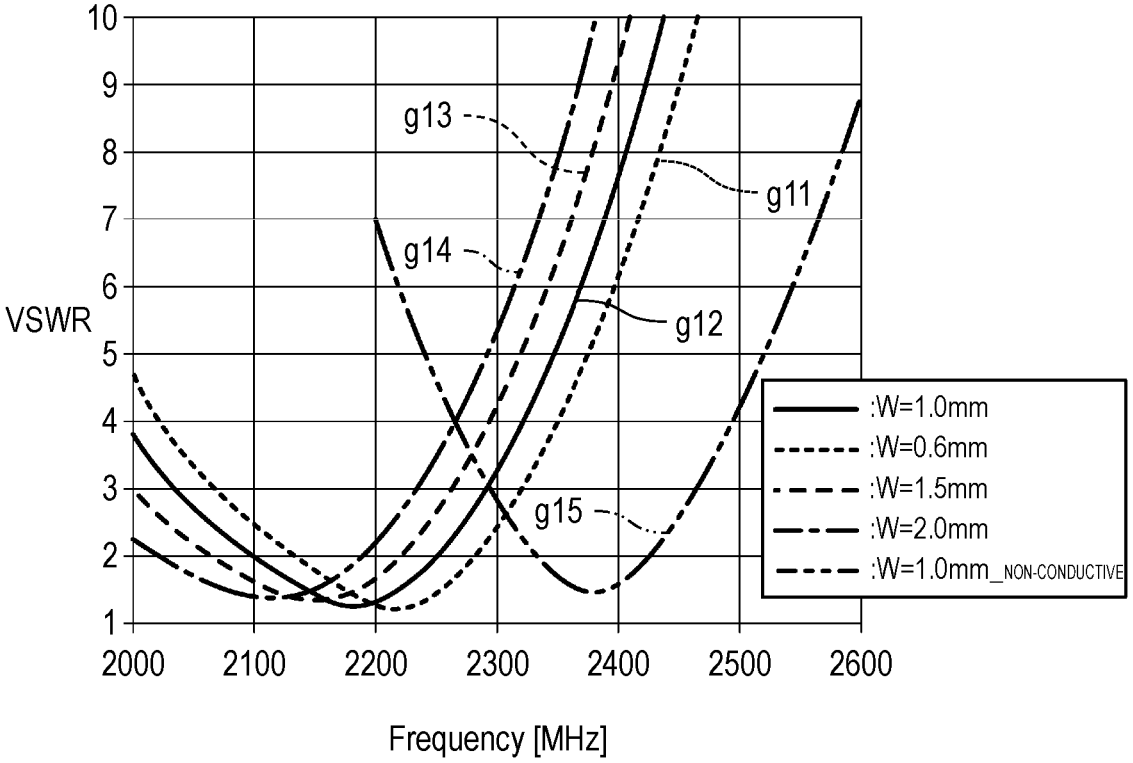
FIG. 11 is a graph illustrating frequency characteristics of a voltage standing wave ratio (VSWR) corresponding to width W of the secondary element.

FIG. 11 is a graph illustrating frequency characteristics of VSWR corresponding to width W of secondary element 15. When width W of secondary element 15 is 0.6 mm, as indicated by graph g11, the center frequency of the VSWR is 2.22 GHz and the fractional bandwidth is about 0.26 GHz. When width W of secondary element 15 is 1.0 mm, as indicated by graph g12, the center frequency of the VSWR is 2.18 GHz and the fractional bandwidth is about 0.26 GHz. When width W of secondary element 15 is 1.5 mm, as indicated by graph g13, the center frequency of the VSWR is 2.16 GHz and the fractional bandwidth is about 0.26 GHz. When width W of secondary element 15 is 2.0 mm, as indicated by graph g14, the center frequency of the VSWR is 2.11 GHz.

Thus, the center frequency of antenna device 101 shifts to a low frequency side with an increase in width W of the secondary element 15. This is presumable due to the fact that an increase in width of secondary element 15 increases the electrical length (path length) of AMC 7, thereby causing parallel resonance to occur easily. However, no large change can be seen regarding the fractional bandwidth. Accordingly, in setting the operation frequency, by increasing width W of secondary element 15, it is possible to make adjustment to shift the operation frequency to a low frequency side. Moreover, by reducing width W of secondary element 15, it is possible to make adjustment to shift the operation frequency to a high frequency side.

Note that when two via conductors 4, 5 are not conductively connected to secondary element 15, as indicated by graph g15, the center frequency of the VSWR is as high as 2.38 GHz and the fractional bandwidth is as narrow as 0.16 GHz. In other words, for example, when two via conductors 4, 5 are connected (conductive) to secondary element 15, but, by making adjustment to cut the connection (conduction) between via conductors 4, 5 and secondary element 15, the operation frequency (center frequency) of the antenna device can be shifted to a high frequency side. Accordingly, in the case of the antenna device in which two via conductors 4, 5 are not conductively connected to secondary element 15, it is difficult to shift the communication frequency to a low frequency side and make a change to a wide band. Moreover, regarding two via conductors 4, 5, in either of the cases where via conductor 4 is conductively connected and via conductor 5 is not conductively connected and where via conductor 4 is not conductively connected and via conductor 5 is conductively connected, shifting of the center frequency of the VSWR to a low frequency side or increasing the fractional bandwidth were not confirmed. Accordingly, in the present disclosure, it is preferable that two via conductors 4, 5 be conductively connected to secondary element 15.

Figure 12:
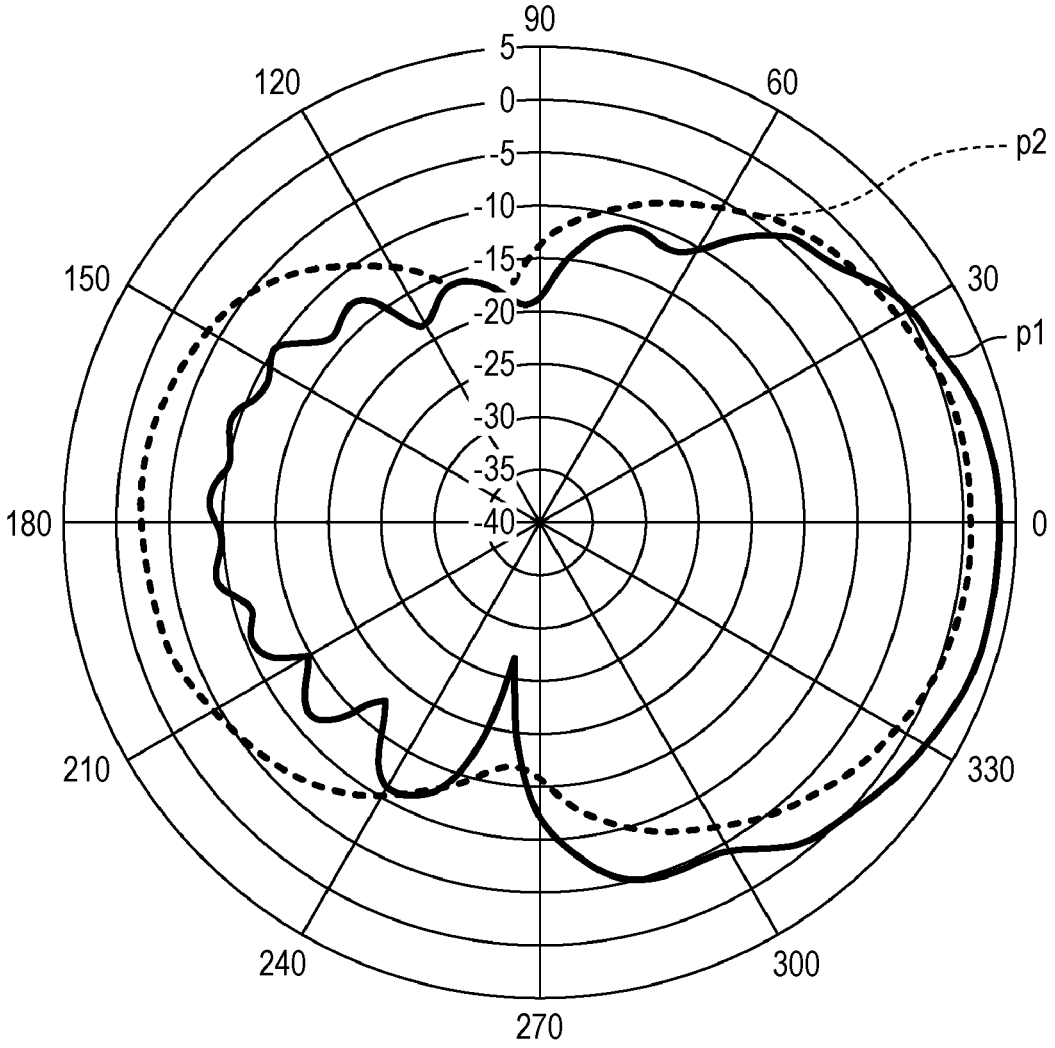
FIG. 12 is a directivity characteristic view illustrating a radio wave radiation pattern in the X-Y plane.

FIG. 12 is a directivity characteristic view illustrating a radio wave radiation pattern in an X-Y plane. FIG. 12 illustrates radiation pattern p2 in the X-Y plane in the case where antenna device 101 is disposed in a free space. Radiation pattern p2 has a peak of gain when the radiation direction of a radio wave is the x direction (0 degree direction). Moreover, the gain on the front side of antenna device 101 (270 degrees-0 degree-90 degrees) is larger than the gain on the back side (90 degrees-180 degrees-270 degrees). Moreover, in radiation pattern p2, a slight fluctuation in gain is not generated with the radiation direction of a radio wave.

Meanwhile, FIG. 12 indicates radiation pattern p1 in the X-Y plane obtained when antenna device 101 is incorporated into pocket 210 of metal frame 200 of cabin monitor 250. Radiation pattern p1 has the peak of gain when the radiation direction of a radio wave is the x direction (0 degree direction), i.e., on the user side watching cabin monitor 250. Moreover, the gain on the front side of antenna device 101 (270 degrees-0 degree-90 degrees) is larger than the gain on the back side (90 degrees-180 degrees-270 degrees). Moreover, in radiation pattern p1, the gain slightly fluctuates with the radiation direction of a radio wave. This is presumable due to the fact that, because antenna device 101 is incorporated into pocket 210 of metal frame 200 of cabin monitor 250, the gain is influenced by inner components of cabin monitor 250 including metal frame 200.

Thus, even when antenna device 101 is incorporated into pocket 210 of metal frame 200, the antenna performance of antenna device 101 is not largely reduced. Rather, the gain on the front side (300 degrees-30 degrees) including the peak gain of radiation pattern p1 of antenna device 101 incorporated into metal frame 200 is larger than the gain of radiation pattern p2 of antenna device 101 disposed in the free space. Accordingly, antenna device 101 can efficiently emit a radio wave to the front side of cabin monitor 250 (x direction) in the X-Y plane.

Figure 13:
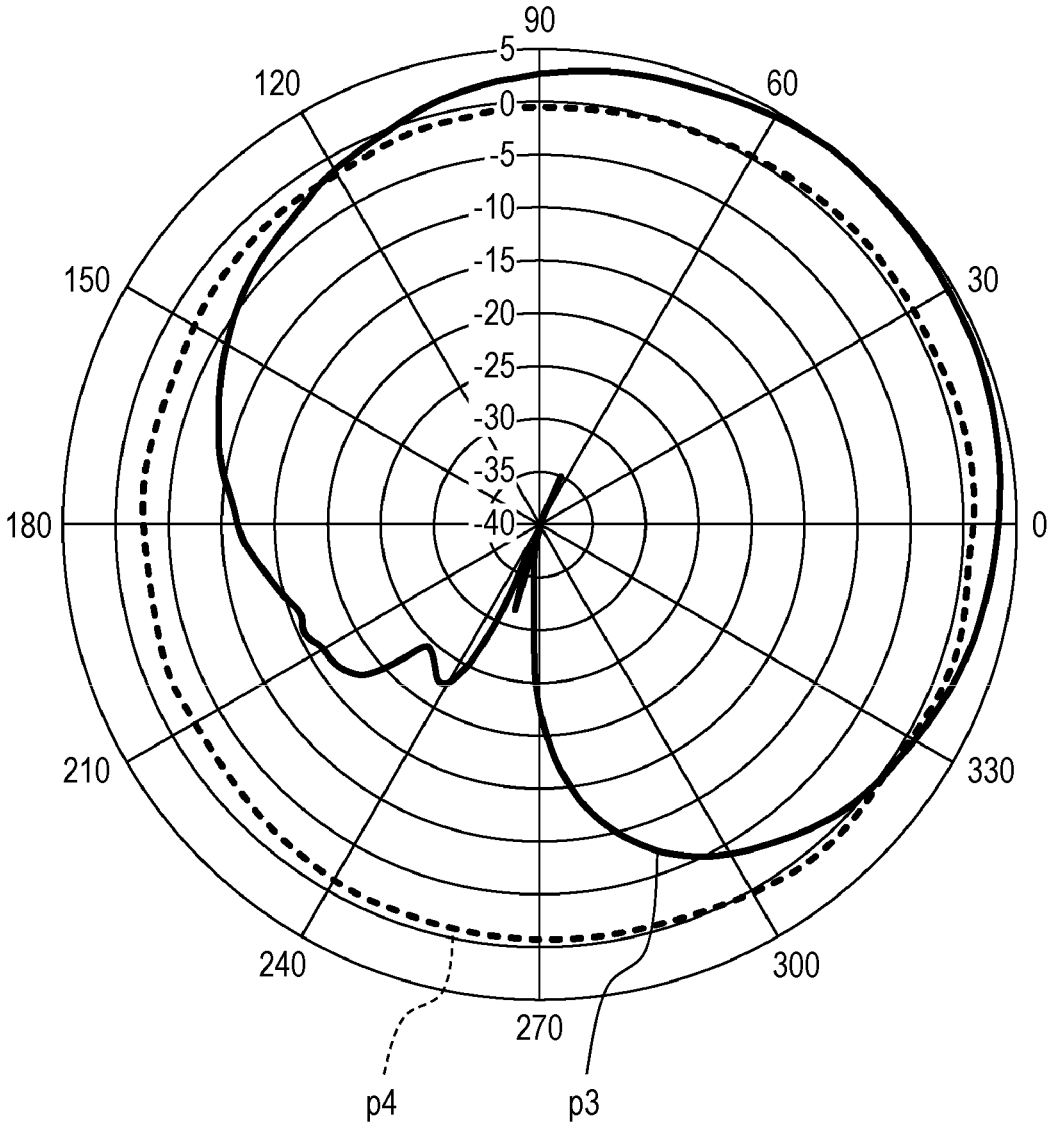
FIG. 13 is a directivity characteristic view illustrating a radio wave radiation pattern in the X-Z plane.

FIG. 13 is a directivity characteristic view illustrating a radio wave radiation pattern in an X-Z plane. FIG. 13 illustrates radiation pattern p4 in the X-Z plane in the case where antenna device 101 is disposed in the free space. Radiation pattern p4 has a substantially uniform gain in the X-Z plane.

Meanwhile, FIG. 13 illustrates radiation pattern p3 in the X-Z plane obtained when antenna device 101 is incorporated into pocket 210 of metal frame 200. Radiation pattern p3 has a substantially uniform gain on the front side (300 degrees-90 degrees) of antenna device 101 in the radiation direction of a radio wave in the X-Z plane. Moreover, radiation pattern p3 has a null between 240 degrees and 270 degrees of the radiation direction of a radio wave, and the gain is significantly reduced. This is presumable due to the fact that, because antenna device 101 is incorporated into metal frame 200 of cabin monitor 250, the gain is influenced by inner components of cabin monitor 250 including metal frame 200.

Thus, when antenna device 101 is incorporated into pocket 210 of metal frame 200, the antenna performance is not largely reduced on the front side of antenna device 101 in the X-Z plane. Rather, the gain on the front side (330 degrees-90 degrees) of radiation pattern p3 of antenna device 101 incorporated into metal frame 200 is larger than the gain of radiation pattern p4 of antenna device 101 disposed in the free space. Accordingly, antenna device 101 can efficiently emit a radio wave to the front side of the cabin monitor (x direction) in the X-Z plane.

Figure 14:
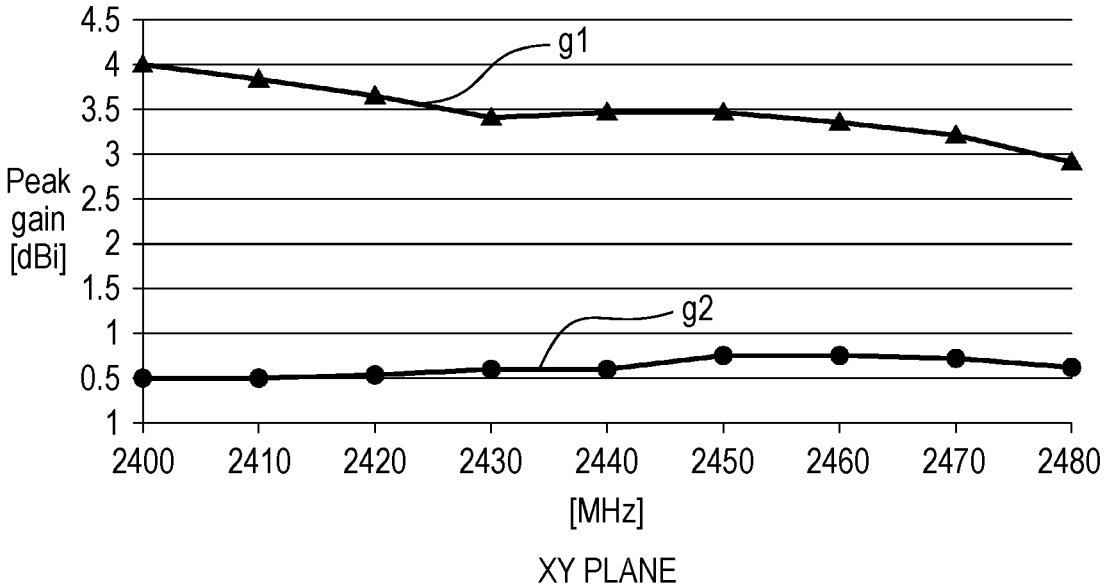
FIG. 14 is a graph illustrating a change in peak gain with respect to a frequency of a radio wave in the X-Y plane.

FIG. 14 is a graph illustrating a change in peak gain with respect to a frequency of a radio wave in the X-Y plane. The vertical axis indicates peak gain (dBi), and the horizontal axis indicates a frequency band of 2.40 GHz to 2.48 GHz. FIG. 14 illustrates peak gain g2 in the X-Y plane obtained when antenna device 101 is disposed in the free space. In 2.40 GHz to 2.48 GHz, peak gain g2 indicates a small value close to 0.5 dBi. Moreover, FIG. 14 illustrates peak gain g1 in the X-Y plane obtained when antenna device 101 is incorporated into pocket 210 of metal frame 200. In 2.40 GHz to 2.48 GHz, peak gain g1 indicates a large value in a range of 4.0 dBi to 3.0 dBi, indicating the tendency that the gain increases at a lower frequency.

As described above, according to a comparison between peak gain g1 and peak gain g2, as compared with the case where antenna device 101 is disposed in the free space, when antenna device 101 is incorporated into pocket 210 of metal frame 200 of cabin monitor 250, it is possible to strengthen a radio wave emitted from the front surface of antenna device 101 in the X-Y plane.

Figure 15:
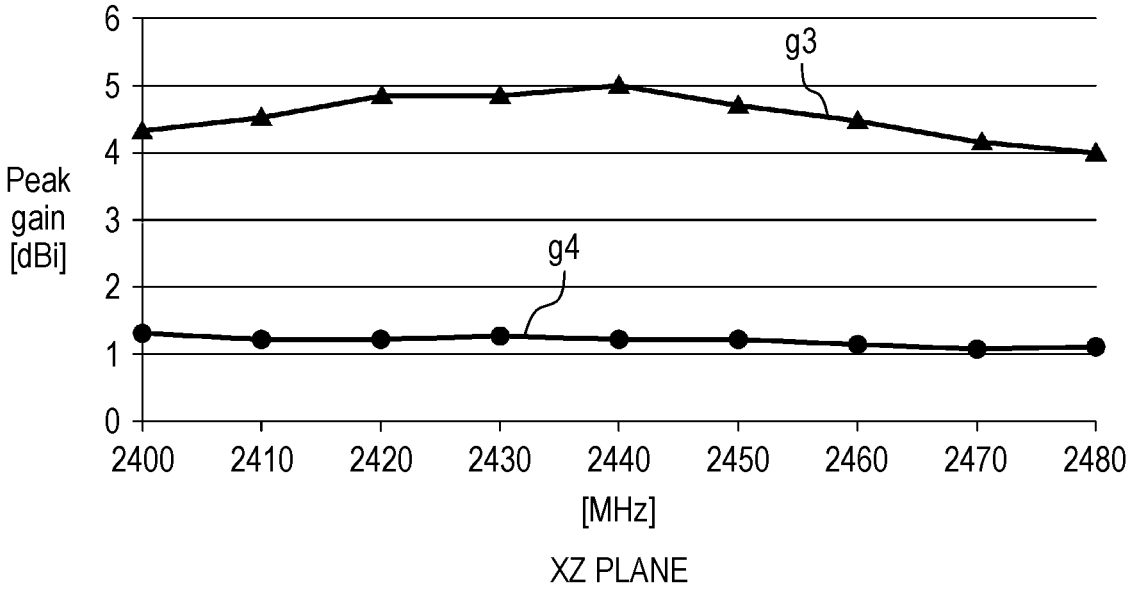
FIG. 15 is a graph illustrating a change in peak gain with respect to a frequency of a radio wave in the X-Z plane.

FIG. 15 is a graph illustrating a change in peak gain with respect to a frequency of a radio wave in the X-Z plane. The vertical axis indicates peak gain (dBi), and the horizontal axis indicates a frequency band of 2.40 GHz to 2.48 GHz. FIG. 15 illustrates peak gain g4 in the X-Z plane obtained when antenna device 101 is disposed in the free space. In 2.40 GHz to 2.48 GHz, peak gain g4 indicates a small value close to 1.0 dBi. Moreover, FIG. 15 illustrates peak gain g3 in the X-Z plane obtained when antenna device 101 is incorporated into pocket 210 of metal frame 200. In 2.40 GHz to 2.48 GHz, peak gain g3 indicates a large value in a range of 4.0 dBi to 5.0 dBi, indicating the characteristic that the gain is the largest near 2.4 GHz.

As described above, according to a comparison between peak gain g3 and peak gain g4, as compared with the case where antenna device 101 is disposed in the free space, when antenna device 101 is incorporated into pocket 210 of metal frame 200, it is possible to strengthen a radio wave emitted from the front surface of antenna device 101 in the X-Z plane.

As described above, antenna device 101 of the exemplary embodiment includes antenna conductors 2, 3, ground conductor 8, AMC 7 sandwiched between antenna conductors 2, 3 and ground conductor 8 so as to be disposed separately from antenna conductors 2, 3 and ground conductor 8, and secondary element 15 disposed on a side opposite to AMC 7 across antenna conductors 2, 3 so as to be disposed furthest away from ground conductor 8.

Thus, in antenna device 101, unlike AMC 7 disposed on the intermediate layer, secondary element 15 disposed furthest away from ground conductor 8 is disposed on the outermost. Therefore, it is possible to easily adjust the operation frequency applicable for wireless communication and efficiently maintain the frequency characteristics of the operation frequency band with secondary element 15.

Moreover, antenna device 101 further includes via conductor 5 that is disposed separately from the center of dielectric substrate 14 having a substantially rectangular shape on which secondary element 15 is disposed and that conductively connects antenna conductor 3, secondary element 15, AMC 7, and ground conductor 8. Thus, secondary element 15 has a function of an antenna conductor, and secondary element 15 can be included as a part of antenna device 101. Thus, as the performance of antenna device 101, it is possible to shift the operation frequency to a low frequency side and increase the gain.

Moreover, secondary element 15 includes feed-side terminal 15*p* of via conductor 4 and ground-side terminal 15*q* of via conductor 5. Feed-side terminal 15*p* and ground-side terminal 15*q* are conductively connected to AMC 7 via via conductors 4, 5, respectively. Thus, antenna device 101 can adjust the operation frequency with secondary element 15 and improve the antenna performance.

Moreover, length L of secondary element 15 in the longitudinal direction is variable. Therefore, the center frequency of the VSWR shifts to a low frequency with an increase in length of secondary element 15. Accordingly, in setting the operation frequency, by increasing length L of secondary element 15, it is possible to make adjustment to shift the operation frequency to a low frequency side. Moreover, by reducing length L of secondary element 15, it is possible to make adjustment to shift the operation frequency to a high frequency side. Moreover, the longer length L of secondary element 15, the larger the value of the fractional bandwidth of the VSWR. Therefore, by increasing length L of secondary element 15, it is possible to make adjustment to increase the fractional bandwidth of the VSWR.

Moreover, the length of secondary element 15 in the width direction, i.e., width W, is variable. Thus, the center frequency of antenna device 101 shifts to a low frequency side with an increase in width W of secondary element 15. Accordingly, in setting the operation frequency, by increasing width W of secondary element 15, it is possible to make adjustment to shift the operation frequency to a low frequency side. Moreover, by reducing width W of secondary element 15, it is possible to make adjustment to shift the operation frequency to a high frequency side.

Moreover, antenna device 101 further includes parasitic conductor 6 provided on dielectric substrate 10 on which antenna conductors 2, 3 are disposed. As parasitic conductor 6 is electrostatically coupled to AMC 7 similar to antenna conductors 2, 3, parasitic conductor 6 can increase electrostatic capacitance between antenna conductors 2, 3 and AMC 7 and shift a radio frequency handled by antenna device 101 to a low frequency side.

Moreover, ground conductor 8 and AMC 7 are disposed to face each other and substantially overlap on plan view. Thus, one of AMC 7 and ground conductor 8 does not protrude over the other, making a contribution to reducing the size of printed circuit board 1, eventually resulting in a reduction in size of antenna device 101.

Moreover, antenna device 101 is incorporated into pocket 210 of metal frame 200 of cabin monitor 250 (i.e., disposed in a vicinity of a space that at least partially includes metal). Antenna device 101 improves the antenna performance with secondary element 15. Therefore, even when incorporated into metal frame 200, antenna device 101 can match the operation frequency band to a desired frequency band and maintain the antenna performance.

Moreover, antenna device 101 is a dipole antenna including antenna conductor 2 and antenna conductor 3. Via conductor 5 on the ground side conductively connects secondary element 15, antenna conductor 3, AMC 7, and ground conductor 8. Via conductor 4 on the feed side conductively connects secondary element 15 and antenna conductor 2. Thus, antenna device 101 can achieve a dipole antenna that allows easy adjustment of communication frequency (i.e., operation frequency) applicable for wireless communication.

Moreover, AMC 7 includes the slit that separates electrostatic coupling between antenna conductor 2 formed on the upper layer and antenna conductor 3 formed on the upper layer. Thus, it is possible to increase electrostatic coupling between antenna conductor 2 and a right half portion of AMC 7 (i.e., the +y direction illustrated in FIG. 3) and electrostatic coupling between antenna conductor 3 and a left half portion of AMC 7 (i.e., the −y direction illustrated in FIG. 3).

Heretofore, the exemplary embodiment has been described with reference to the accompanying drawings. However, the present disclosure is not limited to the example. It is apparent that those skilled in the art may conceive of various change examples, modification examples, replacement examples, addition examples, deletion examples, and equivalent examples within the scope of the claims, which are understood to fall within the technical scope of the present disclosure. Moreover, the constituent elements of the aforementioned exemplary embodiment may be optionally combined without departing from the gist of the present disclosure.

For example, the aforementioned exemplary embodiment indicates the case where the antenna device transmits a radio wave of a high frequency band of 2.4 GHz. However, the antenna device may transmit a radio wave of another frequency, e.g., 1.9 GHz or 1 GHz.

The present disclosure is useful as an antenna device that easily adjusts an operation frequency applicable for wireless communication and maintains frequency characteristics of an operation frequency band.

What is claimed is:

1. An antenna device comprising:

a first antenna conductor;

a ground conductor;

an artificial magnetic conductor configured to be sandwiched between the first antenna conductor and the ground conductor, and disposed separately from the first antenna conductor and the ground conductor; and a second antenna conductor configured to be disposed on a side opposite to the artificial magnetic conductor across the first antenna conductor and disposed furthest away from the ground conductor.

2. The antenna device according to claim 1, wherein the first antenna conductor, the second antenna conductor, the artificial magnetic conductor, and the ground conductor are conductively connected via a ground-side via conductor, and the ground-side via conductor is disposed separately from a center of a substrate having a rectangular shape on which the second antenna conductor is disposed.

3. The antenna device according to claim 2, wherein the second antenna conductor includes a feed-side terminal and a ground-side terminal, the feed-side terminal is conductively connected to the artificial magnetic conductor via a feed-side via conductor, and the ground-side terminal is conductively connected to the artificial magnetic conductor via the ground-side via conductor.

4. The antenna device according to claim 1, wherein a length of the second antenna conductor in a longitudinal direction is variable.

5. The antenna device according to claim 1, wherein a length of the second antenna conductor in a width direction is variable.

6. The antenna device according to claim 1, further comprising a parasitic conductor that is provided on a substrate on which the first antenna conductor is disposed.

7. The antenna device according to claim 1, wherein the ground conductor and the artificial magnetic conductor are disposed to face each other and overlap each other on a plan view.

8. The antenna device according to claim 1, wherein the antenna device is disposed in a space that at least partially includes metal.

9. The antenna device according to claim 1, wherein the first antenna conductor is a dipole antenna including a feed-side antenna conductor and a ground-side antenna conductor, the second antenna conductor, the ground-side antenna conductor, the artificial magnetic conductor, and the ground conductor are conductively connected via a ground-side via conductor, and the second antenna conductor and the feed-side antenna conductor are conductively connected via a feed-side via conductor.

10. The antenna device according to claim 9, wherein the artificial magnetic conductor includes a slit that separates electrostatic coupling between the feed-side antenna conductor formed on an upper layer and the ground-side antenna conductor formed on an upper layer.

* * * * *